US006659279B2

(12) United States Patent
Hwang

(10) Patent No.: US 6,659,279 B2
(45) Date of Patent: Dec. 9, 2003

(54) ROTARY CONTAINER WITH SEPARABLE NAIL FILES

(75) Inventor: Jae Kwang Hwang, Seoul (KR)

(73) Assignee: F Skorea Ind., Inc., Seoul (KR)

( * ) Notice: Subject to any disclaimer, the term of this patent is extended or adjusted under 35 U.S.C. 154(b) by 92 days.

(21) Appl. No.: 10/102,529

(22) Filed: Mar. 19, 2002

(65) Prior Publication Data

US 2002/0148752 A1 Oct. 17, 2002

(51) Int. Cl.[7] ..... B65D 83/00

(52) U.S. Cl. ..... 206/526; 132/76.5; 206/526; 206/820; 206/823; 221/26; 221/303

(58) Field of Search ..... 132/75.6, 76.4, 132/76.5; 206/37, 39, 526, 581, 820, 823; 221/26, 303

(56) References Cited

U.S. PATENT DOCUMENTS 1,312,653 A * 8/1919 Watrous ..... 132/75.6
2,364,085 A * 12/1944 Martinek ..... 132/73.5
2,551,700 A * 5/1951 Pinco ..... 132/75.6
3,600,729 A * 8/1971 Laughlin et al. ..... 7/118
5,328,026 A * 7/1994 Newman ..... 206/234
5,769,213 A * 6/1998 Chatterton ..... 206/38
5,782,247 A * 7/1998 Sadley et al. ..... 132/76.4
5,857,564 A * 1/1999 Hymowitz ..... 206/209
6,189,154 B1 * 2/2001 Ducharme ..... 2/338
6,394,099 B1 * 5/2002 Daley ..... 132/76.4

* cited by examiner

*Primary Examiner*—Jim Foster
(74) *Attorney, Agent, or Firm*—Porter, Wright, Morris & Arthur, LLP

(57) ABSTRACT

Disclosed is a rotary container with separable nail files, which comprises an upper plate, a lower plate, a file plate rotatably interposed between the upper plate and the lower plate, and a rotary hub inserted through the upper plate, the file plate, and the lower plate. The upper plate has a separation opening extending radially outward from a center of the upper plate. The file plate includes a plurality of file pieces partitioned by a plurality of cutting lines, and each of the cutting lines extends radially outward from a center of the file plate. Each of the file pieces has such a dimension as to be completely exposed through the separation opening, so that each of the file pieces can be pulled up and separated from the file plate through the separation opening. The file plate comprises a base sheet, a cushion sheet attached to one surface of the base sheet, and a file sheet attached to the cushion sheet, the file sheet practically functioning as a nail file. The separation opening of the upper plate and each of the file pieces of the file plate respectively have a sectorial shape in which a length of arc increases in a radially outward direction.

8 Claims, 2 Drawing Sheets

ROTARY CONTAINER WITH SEPARABLE NAIL FILES

BACKGROUND OF THE INVENTION

1. Field of the Invention

The present invention relates to a rotary container with separable nail files, which contains nail file pieces which can be easily separated through a rotation of the container and used in filing a nail.

2. Description of the Prior Art

In general, women spend much time and endeavor in pursuit of beauty. Therefore, women always carry various cosmetic tools with them and occasionally make their toilet by means of the cosmetic tools.

A nail file is one of the cosmetic tools as described above. In usual cases, women carry a separate nail file or a nail clipper provided with a nail file. The nail file provided at the nail clipper has a shape of an elongated plate pivotally connected to the nail clipper through a hinge. In order to use the nail file provided at the nail clipper, a user has to pivot and draw the elongated nail file out of the nail clipper. In contrast, the separate nail file has a simple shape of an elongated plate or a shape of a connection plate on which a plurality of file pieces are detachably arranged.

In the meantime, the separate nail files of those kinds as described above are usually carried in women's handbags, and are problematic in that they have too small dimensions. That is, it is difficult to find out a separate nail file in a bag, because the separate nail file is too small. Sometimes, all contents of a bag have to be drawn out of the bag, in order to find out a separate nail file. Especially, it will bring shame on women to draw out all the contents of a bag in a public place. Moreover, it is very often that the small separate nail file is lost.

Further, the separate nail file is individually encased in a separate container. Therefore, whenever a user uses the separate nail file having multiple file pieces, the user has to draw the separate nail file out of the separate container, and separate one file piece from the connection plate. Also, after the user uses the separated file piece, the user has to put the file piece again into the separated container. In conclusion, a user of the separate nail file has to do a cumbersome labor, in order to use the separate nail file.

SUMMARY OF THE INVENTION

Accordingly, the present invention has been made to solve the above-mentioned problems occurring in the prior art, and an object of the present invention is to provide a the rotary container with separable nail files, which has a reduced thickness and an increased surface area, so as to make it easy to find the rotary container in a bag and reduce a danger that the rotary container is lost.

It is another object of the present invention to provide a rotary container with separable nail files, in which a file piece can be easily separated from a file plate and easily used infilling a nail.

In order to accomplish this object, the present invention provides a rotary container with separable nail files, which comprises an upper plate, a lower plate, a file plate rotatably interposed between the upper plate and the lower plate, and a rotary hub inserted through the upper plate, the file plate, and the lower plate. The upper plate has a separation opening extending radially outward from a center of the upper plate.

The file plate includes a plurality of file pieces partitioned by a plurality of cutting lines, and each of the cutting lines extends radially outward from a center of the file plate. Each of the file pieces has such a dimension as to be completely exposed through the separation opening, so that each of the file pieces can be pulled up and separated from the file plate through the separation opening. The file plate comprises a base sheet, a cushion sheet attached to one surface of the base sheet, and a file sheet attached to the cushion sheet, the file sheet practically functioning as a nail file.

It is preferred that the separation opening of the upper plate and each of the file pieces of the file plate respectively have a sectorial shape in which a length of arc increases in a radially outward direction.

In a rotary container with separable nail files according to the present invention as described above, each of the file pieces is completely exposed through the separation opening, so that each of the file pieces can be pulled up and separated from the file plate through the separation opening, and then used in filing a nail.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, a rotary container with separable nail files according to a preferred embodiment of the present invention will be described with reference to the accompanying drawings.

Figure 1:
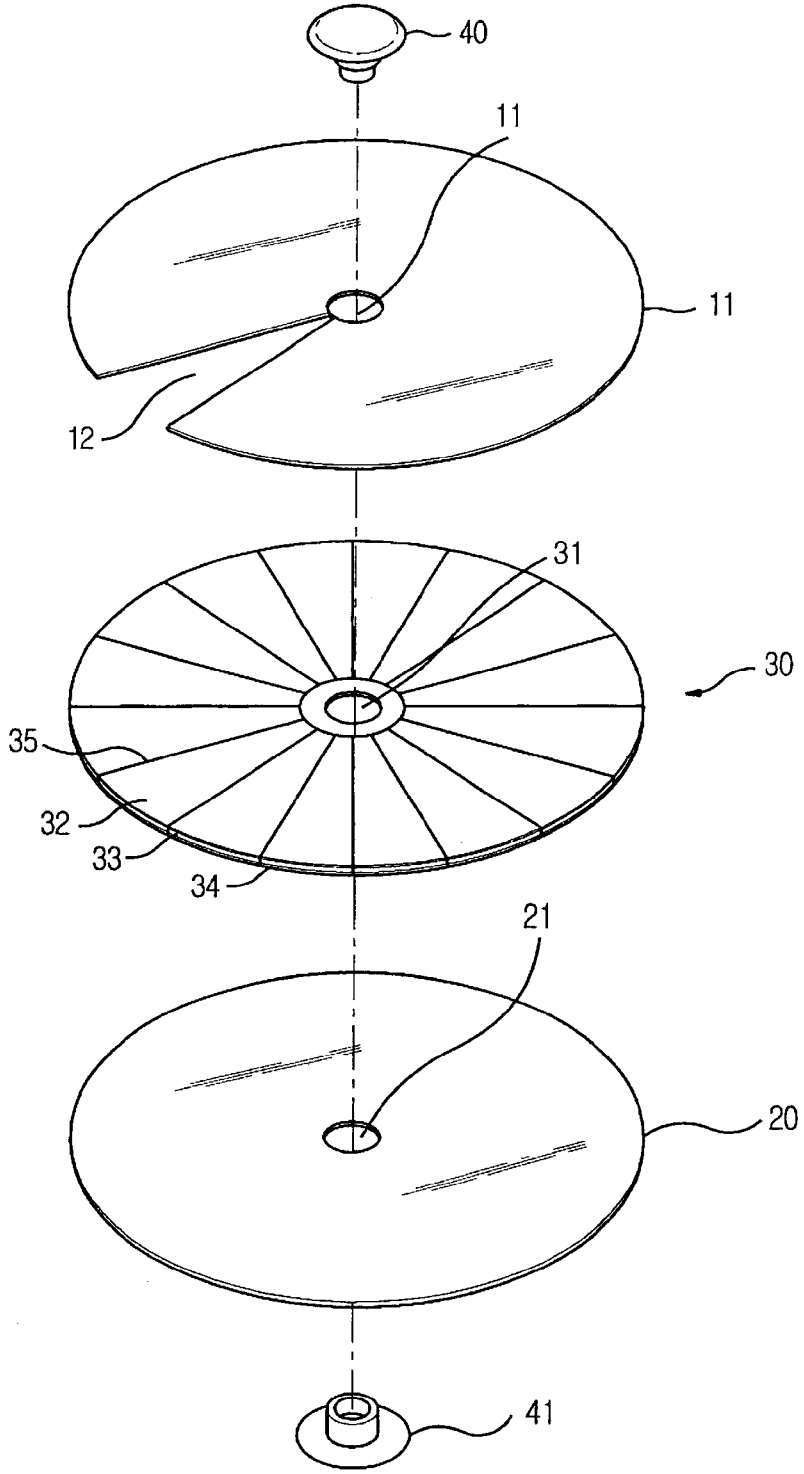
FIG. 1 is an exploded perspective view of a rotary container with separable nail files according to the present invention.
Figure 2:
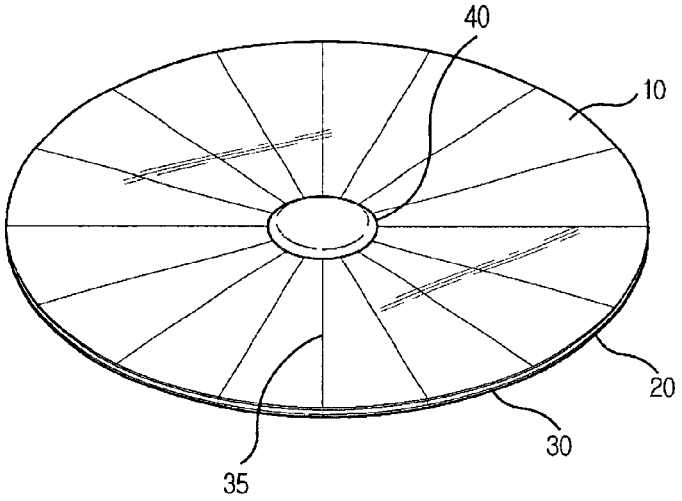
FIG. 2 is a perspective view of a file plate employed in the rotary container shown in FIG. 1.

Referring to FIGS. 1 and 2, a rotary container with separable nail files according to a preferred embodiment of the present invention includes an upper plate 10, a lower plate 20, and an file plate 30 disposed between the upper plate 10 and the lower plate 20. The present embodiment shows the upper plate 10, the lower plate 20, and the file plate 30, each having a shape of a circular disc, which is the most preferable shape in the aspect of convenience in using the rotary container with separable nail files, although they may have other shapes such as a rectangular shape according to other embodiments. The upper plate 10 and the lower plate 20 are made from plastic material, preferably from polystyrene.

An upper axial hole 11, a lower axial hole 21, and an intermediate axial hole 31 are formed through centers of the upper plate 10, the lower plate 20, and the file plate 30. A rotary hub made from synthetic resin having some flexibility is fitted through the upper axial hole 11, the lower axial hole 21, and the intermediate axial hole 31, so as to rotatably support the upper plate 10, the lower plate 20, and the file plate 30. The rotary hub includes an upper cap 40 disposed on an upper surface of the upper plate 10 and having an upper assembling tube, and a lower cap 41 disposed on a lower surface of the lower plate 20 and having a lower assembling tube in which the upper assembling tube is fitted. Therefore, after the upper plate 10, the file plate 30, and the lower plate 20 are overlapped on each other in order while the upper axial hole 11, the lower axial hole 21, and the intermediate axial hole 31 are aligned in line, the lower assembling tube of the lower cap 41 is inserted through the lower axial hole 21, the intermediate axial hole 31, and the upper axial hole 11 in order, and the upper assembling tube of the upper cap 40 is inserted through the upper axial hole 11, the intermediate axial hole 31, and the intermediate axial hole 31 in order, and then the upper assembling tube of the upper cap 40 is fitted in the lower assembling tube of the lower cap 41. In this way, the upper cap 40 and the lower cap 41 can be assembled with each other in a simple and easy manner. Meanwhile, instead of the above construction of the rotary hub according to the present embodiment, the rotary hub may have a different construction, for example, the rotary hub may have a shape of an integral cylinder.

The upper plate 10 has a separation opening 12 formed through the upper plate 10 and extending radially outward from the upper axial hole 11. The separation opening 12 has a sectorial shape, in which the length of arc increases as it comes radially outward from the upper axial hole 11. The file plate 30 has a plurality of file pieces partitioned by a plurality of cutting lines 35 which extend radially outward from the intermediate axial hole 31. Of course, the cutting lines 35 are not connected with but are stopped just before the intermediate axial hole 31. Therefore, the file pieces are maintained connected with each other before they are detached from the file plate 30.

Each of the file pieces as described above is exposed through the separation opening 12. Therefore, each file piece has to have such a dimension as to be exposed through the separation opening 12. Especially, it is preferred that each file piece has a shape similar to that of the separation opening 12, so that the cutting lines 35 of both sides of the file piece are aligned in parallel with both sides of the separation opening 12 when the file piece is located within the separation opening 12. More preferably, each of the file pieces has the same dimension as that of the separation opening 12.

The file plate 30 includes a base sheet 32 facing the upper plate 10, a cushion sheet 33 attached to a rear surface of the base sheet 32, and a file sheet 34 attached to a rear surface of the cushion sheet 33. The cushion sheet 33 may be made from soft material such as sponge, so as to cushion the force applied to the file sheet 34, thereby preventing too strong force from being applied to a nail when the nail is filed. In this case, although it is most preferred that the file sheet 34 is attached to one surface of the cushion sheet 33 as is in the present embodiment, the file sheet 34 may be attached to both surfaces of the cushion sheet 33 without the base sheet 32 or both surfaces of the base sheet 32 without the cushion sheet 33, according to other embodiments of the present invention.

Hereinafter, described will be an action of filing a nail by the rotary container with separable nail files according to the present embodiment as described above.

Figure 3:
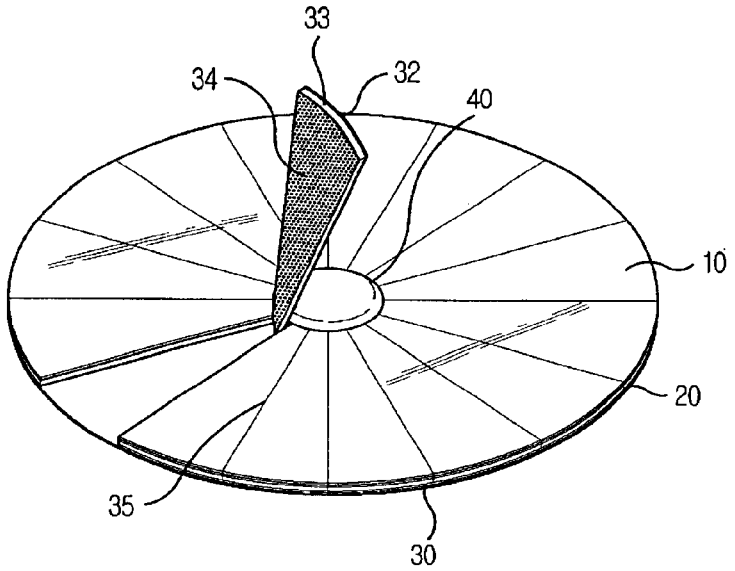
FIG. 3 is a perspective view of the file plate of FIG. 2, illustrating a state when a sectorial file piece is detached from the file plate.

First, the upper plate 10 is rotated so that one file piece is exposed through the separation opening 12. Then, the exposed file piece is bent upward as shown in FIG. 3 through the separation opening 12. In this state, the bent file piece is not separated from the file plate 30 yet.

Thereafter, the bent file piece is pulled up and separated from the file plate 30. Then, a nail can be filed by means of the separated file piece. That is, the nail is filed by the file sheet 34 of the file piece. Each file piece can be used until its file sheet 34 is worn out.

When the file sheet 34 of the separated file piece is worn out and the separated file piece is wasted, the upper plate 10 is rotated again, so that another file piece is separated through the separation opening 12 of the upper plate 10 and then used.

Since the upper plate 10 and the lower plate 20 are made from transparent material, both surfaces of the file plate 30 may be coated with various colors or patterns, so as to improve aesthetic value of the appearance of the nail file or the rotary container with separable nail files.

Further, it is preferred that the rotary container with separable nail files according to the present invention as described above has a diameter of about the lower plate 20 cm and a thickness of about 0.5 cm. Therefore, the rotary container with separable nail files according to the present invention does not take a large space in a bag due to its very small thickness as described above, while it is very easy to find out the rotary container in the bag due to its large diameter.

As described above in detail, in a the rotary container with separable nail files according to the present invention, a file piece can be easily separated from the file plate according to a rotation of the upper plate, so that the rotary container enables the nail file or a nail file piece to be easily used.

Moreover, a rotary container with separable nail files according to the present invention has a reduced thickness and an increased surface area, so as to make it easy to find the rotary container in a bag and reduce a danger that the rotary container is lost. Therefore, the rotary container with separable nail files according to the present invention prevents women from drawing all the contents out of a bag in order to find a nail file, which women are unwilling to do.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A rotary container with separable nail files, the rotary container comprising:

an upper plate having a separation opening, the separation opening extending radially outward from a center of the upper plate;

a lower plate;

a file plate rotatably interposed between the upper plate and the lower plate, the file plate including a plurality of file pieces partitioned by a plurality of cutting lines, each of the cutting lines extending radially outward from a center of the file plate; and a rotary hub inserted through the upper plate, the file plate, and the lower plate, in such a manner as that the upper plate, the file plate, and the lower plate can be rotated about the rotary hub, wherein each of the file pieces has such a dimension as that each of the file pieces can be completely exposed through the separation opening and separated from the file plate through the separation opening.

2. A rotary container with separable nail files according to claim 1, wherein the upper plate and the lower plate are transparent.

3. A rotary container with separable nail files according to claim 1, wherein the separation opening of the upper plate and each of the file pieces of the file plate respectively have a sectorial shape in which a length of arc increases in a radially outward direction.

4. A rotary container with separable nail files according to claim 1, wherein the file plate comprises a base sheet, a cushion sheet attached to one surface of the base sheet, and a file sheet attached to the cushion sheet.

5. A rotary container with separable nail files according to claim 4, wherein the cushion sheet is made from sponge.

6. A rotary container with separable nail files according to claim 1, wherein the file plate comprises a cushion sheet, and at least a file sheet attached to at least one of both sides of the cushion sheet.

7. A rotary container with separable nail files according to claim 6, wherein the cushion sheet is made from sponge.

8. A rotary container with separable nail files according to claim 1, wherein the file plate comprises a base sheet, and at least a file sheet attached to at least one of both sides of the base sheet.

* * * * *